United States Patent [19]

Becuwe

[11] Patent Number: 5,034,072

[45] Date of Patent: Jul. 23, 1991

[54] 5-OXO-3-NITRO-1,2,4-TRIAZOLE IN GUNPOWDER AND PROPELLANT COMPOSITIONS

[75] Inventor: Alain Becuwe, Mennecy, France

[73] Assignee: Societe Nationale des Poudres et Explosifs, Paris, France

[21] Appl. No.: 354,249

[22] Filed: May 19, 1989

Related U.S. Application Data

[63] Continuation of Ser. No. 879,482, Jun. 27, 1986, abandoned.

[30] Foreign Application Priority Data

Jun. 28, 1985 [FR] France ..... 85 09885

[51] Int. Cl.[5] ..... C06B 45/10

[52] U.S. Cl. ..... 149/19.4; 149/19.1; 149/19.8; 149/19.9; 149/92; 149/94; 149/96; 149/97

[58] Field of Search ..... 149/19.1, 19.4, 19.9, 149/92, 19.8, 94, 96, 97

[56] References Cited

U.S. PATENT DOCUMENTS

| | | | |
|---|---|---|---|
| 3,707,411 | 12/1972 | Gawlick | 149/14 |
| 3,985,595 | 10/1976 | Benziger | 149/19.3 |
| 4,216,039 | 8/1980 | Pierce | 149/19.4 |
| 4,236,014 | 11/1980 | Lee et al. | 548/267 |
| 4,289,551 | 9/1981 | Perrault et al. | 149/19.9 |
| 4,300,962 | 11/1981 | Stinecipher et al. | 149/92 |
| 4,361,450 | 11/1982 | Maason | 149/19.91 |
| 4,555,277 | 11/1985 | Scribner | 149/19.4 |
| 4,608,102 | 8/1986 | Krampen et al. | 149/92 |
| 4,623,409 | 11/1986 | Lee | 149/92 |
| 4,726,919 | 2/1988 | Kristofferson et al. | 149/19.4 |
| 4,733,610 | 3/1988 | Lee et al. | 149/88 |

FOREIGN PATENT DOCUMENTS 185555 1/1922 United Kingdom .

OTHER PUBLICATIONS

Katritzky et al., *Chem Abs.*, 98 (#19), abs. #159930y, (1982).

Kotman et al., *Chem Abs.*, 95 (#9) abs #80833y, (1981).

Kotman et al. II, *Chem. Abs.*, 93(#1), abs #72117, (1980).

Kroeger et al, *Chem. Abs.*, 70 (#19), abs #87692u, (1969).

Lee et al, II, "3-nitro-1,2,4-triazolo-5-One, A Less Sensitive Explosive", 6 pp., Report LA-10302-MS, Issued Feb. 1985, available at NTIS the 21st week of 1986 (Stock #DE 86009787).

*Primary Examiner*—Edward A. Miller

*Attorney, Agent, or Firm*—Burns, Doane, Swecker & Mathis

[57] ABSTRACT

Use of 5-oxo-3-nitro-1,2,4-triazole in gunpowder and propellant compositions are disclosed. Such compositions include triple base gunpowders further containing nitrocellulose and a liquid nitric ester such as nitroglycerine. Lowered flame temperatures of the gunpowder and reduced firearm barrel erosion is achieved thereby. The solid propellants include gas-generating compound propellants, less hygroscopic than a propellant contaning ammonium nitrate.

22 Claims, No Drawings

5-OXO-3-NITRO-1,2,4-TRIAZOLE IN GUNPOWDER AND PROPELLANT COMPOSITIONS

This application is a continuation of Ser. No. 06/879,482, filed June 27, 1986, now abandoned.

BACKGROUND AND SUMMARY OF THE INVENTION

The present invention relates to a new secondary explosive and to new pyrotechnic compositions, especially new gunpowder and propellant compositions.

Secondary explosives and pyrotechnic compositions such as explosive compositions, powders for firearms, and propellants, are very widely employed both in the arms industry and in nonmilitary fields such as space technology, mining and quarrying, public works, and the like.

Very many secondary explosives and explosive compositions are known. According to J. Quinchon's "Les poudres, propergols et explosifs", volume 1: "les explosifs, Technique et Documentation" (Powders, propellants and explosives, volume 1: explosives, Technology and Data), 1982, there may be mentioned, for example:

as secondary explosives: trinitrotoluene (tolite or TNT), trinitrophenol, trinitrotriaminobenzene (TATB), hexanitrostilbene (HNS), pentrite, nitroglycerine, hexogen (RDX), octogen (HMX), tetryl, nitroguanidine (NGu), dinitroglycolurea and tetranitroglycolurea, as explosive compositions: industrial explosives such as, in particular dynamite and nitrate explosives, and military explosive compositions such as, in particular wax-explosive mixtures (hexowaxes, octowaxes, and the like), tolite-based mixtures (hexolites, pentolites, and the like) and mixtures containing a plastic binder, among which a distinction may be made between those manufactured by compression (compressed explosives) and those manufactured by casting (compound explosives).

It is also known to use secondary explosives, for example HMX, RDX, NGu, as an oxidizer charge in powders for firearms, or in propellants.

In particular, there may be mentioned, without implying any limitation:

triple-base powders for firearms, consisting of nitrocellulose-nitroglycerine, nitroguanidine or hexogen, compound powders with an inert binder for firearms, which essentially comprise an organic binder (for example polyurethane) and a secondary explosive which acts as an oxidizer charge (for example hexogen), and compound propellants filled, for example, with octogen or ammonium nitrate (in the case of gas-generating propellants).

In the technology of explosives it is well-known that for some applications it is necessary to use secondary explosives which combine a high density with a high detonation velocity.

Secondary explosives which meet both these conditions and which are used to this day are, chiefly: cyclotetramethylenetetranitramine, also known as octogen or HMX, and cyclotrimethylenetrinitramine, also known as hexogen or RDX.

The explosive characteristics of these products are known; the main ones are collated- in Table 1, in comparison with those of tolite.

TABLE 1

| | OCTOGEN | HEXOGEN | TOLITE |
|---|---|---|---|
| Density $\rho$ (g/cm$^3$) | 1.91 | 1.82 | 1.65 |
| Detonation velocity (m/s) | 9,100 at $\rho$ = 1.91 | 8,850 at $\rho$ = 1.82 −8,520 at −$\rho$ 1.71 | 6,960 at $\rho$ = 1.65 |
| Impact sensitivity (J) | 5.2 | 4.5 (CH) 5.5 (B) | 48% at 50 J |
| Friction sensitivity (N) | 100 | 113 (CH) 174 (B) | 290 |

Since the detonation velocity varies with the density, the results include the corresponding density.

The sensitivity of the explosives depends, among other factors, on the commercial variety. In the case of hexogen, the results are given for two of these (B and CH).

Impact sensitivity and friction sensitivity are determined by means of the Julius Peters apparatus, according to the method described by H. D. Mallory (The development of impact sensitivity tests at the Explosive Research Laboratory, Bruceton, Pa. during the years 1941–1945 US Naval Ordnance Lab.; White Oak, Md., 1956, report 4236).

When the maximum energy of the test apparatus is reached, the percentage of detonations in tests at this energy is shown.

Compared to tolite, octogen and hexogen have the major advantage of having markedly higher densities and detonation velocities. The disadvantage of these compounds, however, is that they are very markedly more sensitive to impact and to friction than tolite, and this results in some difficulties or constraints in use.

The use of secondary explosives in munition charges requires them to be provided in the form of suitable compositions. It is becoming increasingly rare for a secondary base explosive to be used directly; it is formulated in a variety of explosive compositions which are more appropriate to the constraints in their use and to its operational requirements.

Bearing in mind the sensitivity of certain compositions, it has been necessary to develop desensitized explosive compositions in order to enable these compositions to be charged and handled more easily.

For this purpose, for example, a binder which is either plastic and inert, or active such as molten tolite, has been incorporated in the compositions. Nevertheless, when subjected to some attacks such as, for example, bullet impact, these compositions are still too sensitive, and this has led to a search for solutions in terms of the secondary explosive itself, in addition to coating with a less sensitive binder.

For this purpose it is known, for example, to use TATB as a partial replacement for HMX or RDX in explosive compositions.

TATB and tolite exhibit low sensitivity to external attacks (impact, friction, temperature rise), and this enables the sensitivity of compositions to be reduced, at the cost, however, of a drop in performance.

It has now found that, unexpectedly, 5-oxo-3-nitro-1,2,4-triazole (generally referred to as oxynitrotriazole) has advantageous properties which enable it to be used as a secondary explosive instead of, and as a replacement for, octogen or hexogen, while exhibiting a sensitivity which is as low as that of tolite.

These advantageous properties are the following:

density ($\rho$): 1.91 g/cm$^3$ detonation velocity: 7,770 m/s at $\rho=1.71$ g/cm$^3$
impact sensitivity: 22 J
friction sensitivity: 7% at 353 N.

The calculated detonation velocity at $\rho=1.91$ g/cm$^3$ is 8,590 m/s.

The methods employed are the same as those employed to obtain the results shown in Table 1.

Oxynitrotriazole has the enormous advantage of having an explosive performance which lies close to that of hexogen, bearing in mind its high density, without having the sensitivity of hexogen or octogen (refer to Table 1).

Partial or total substitution of oxynitrotriazole for hexogen enables the sensitivity of explosive compositions to be reduced while retaining virtually the same performance level. Partial substitution of oxynitrotriazole for octogen enables, while retaining a satisfactory performance level, the sensitivity of the explosive compositions to be reduced so as to meet a users' requirement which could not be met by a charge containing octogen alone.

These unexpected results permit a considerable technological step forward in the field of explosive compositions.

It has also been found that oxynitrotriazole could be used as an oxidizer charge instead of, and to replace, explosive substances which are usually employed in powders for firearms, such as, for example, triple-base powders and compound powders, as well as in compound propellants.

When compared to the use of powders which are known at present, the use of oxynitrotriazole in powders for firearms produces, unexpectedly, a lowering in the flame temperature, and consequently a decrease in erosion of the firearm barrel, and this is of great importance in practice.

Furthermore, the use of oxynitrotriazole as a replacement for ammonium nitrate in gas-generating compound propellants offers a number of advantages, the greatest of which is that oxynitrotriazole is markedly less hygroscopic than ammonium nitrate.

DESCRIPTION OF THE PREFERRED EMBODIMENTS

The subject of the present invention is therefore the use of 5-oxo-3-nitro-1,2,4-triazole in gunpowder and propellant compositions.

5-Oxo-3-nitro-1,2,4-triazole, the compound of formula

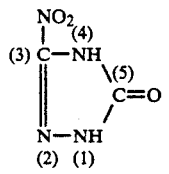

generally known as oxynitrotriazole, is also sometimes referred to as oxonitrotriazole or nitrotriazolone.

Oxynitrotriazole is, for example, obtained in 2 stages from two widely used starting materials: semicarbazide hydrochloride and formic acid.

The reaction scheme of this process is as follows:

1st stage:

-continued

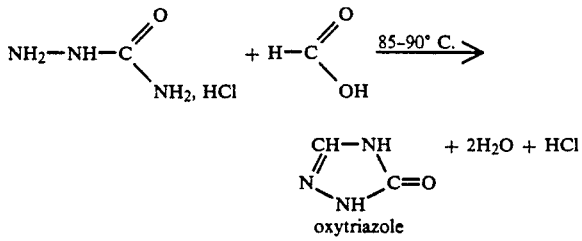

2nd stage:

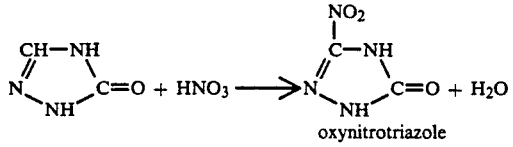

In the 1st stage, the reaction of semicarbazide hydrochloride with formic acid in an aqueous medium for several hours at 85°-90° C. enables 5-oxo-1,2,4-triazole (generally referred to as oxytriazole) to be formed and then isolated in a yield of the order of 80%.

The 2nd stage consists in nitrating the oxytriazole obtained in this manner, for example using 98% nitric acid, at ambient temperature, for several hours. Oxynitrotriazole is isolated from the mixture in accordance with a conventional technology which is well-known to the specialist, in an overall yield, for the two stages together, in the region of 65%.

Oxynitrotriazole has a detonation velocity which lies close to that of hexogen and its impact and friction sensitivities are very markedly lower than those of octogen and hexogen, the sensitivities obtained for oxynitrotriazole being similar to those obtained for tolite.

Oxynitrotriazole also has other advantageous characteristics which make its use as a secondary explosive advantageous and especially favourable:

It decomposes without melting at about 270° C. (a decomposition between 268° and 286° C., with a maximum at 279° C. is observed on differential thermal analysis). This temperature is relatively high (for example, hexogen decomposes between 160° and 200° C.).

Its density is high: $\rho=1.91$ g/cm$^3$.

Its stability under vacuum is advantageous; the test consisting in heating the product under vacuum at a given temperature and measuring the volume of gas emitted as a function of time yields the following result:

100° C.: 1.4 cm$^3$/g in 193 h
130° C.: 1.5 cm$^3$/g in 193 h
150° C.: 1.7 cm$^3$/g in 193 h.

The heat of formation $\Delta Hf$ is $-828$ J/g, or $-107.7$ kJ/mol.

It is particularly compatible with oxygen and the usual binders for explosives containing a plastic binder, powders and compound propellants.

Crystallization trials, particularly in water with slow stirring (uniform, almost spherical crystals with an average diameter of the order of 100 to 150 μm) and in water with stirring but with programmed cooling down to 0° C., have shown that it is possible to obtain crystals which are large enough to be readily used in formulations.

In addition to its use as a secondary explosive in the form of a pure product, oxynitrotriazole may be used in pyrotechnic compositions and especially explosive compositions.

It may also be used as a secondary explosive in the form of a mixture with a compound in which it is virtually insoluble and permitting charging in the molten state (use with molten tolite, for example).

Oxynitrotriazole may also be used as a secondary explosive when mixed with waxes or, more generally, with plastic materials permitting compression charging.

It is also possible to use oxynitrotriazole as an oxidizer charge in powders for firearms, especially triple-base powders and compound powders, as well as in compound propellants.

The new explosive compositions according to the invention are characterized in that they contain 5-oxo-3-nitro-1,2,4-triazole. They are obtained in accordance with traditional processes which are well-known to the specialist, by partial or total substitution of oxynitrotriazole for the secondary explosives which are usually employed.

According to a first preferred alternative embodiment, the explosive compositions are explosive compositions with a plastic binder, which are introduced by compression. Such compositions are produced in accordance with conventional processes which are well-known to the specialist for obtaining explosive compositions with a plastic binder which are introduced by compression. Those described in French Patents 1,602,614 and 1,469,198 may be mentioned, for example. The base material consists of granulates in which the crystals of explosives are coated with a plastic. In most cases these granulates are produced according to a dry coating process, oxynitrotriazole being soluble in water. They are then compressed at a high pressure (of the order of $10^8$ Pa), after the moulding powder has been reheated, in the case of thermoplastic binders, or at ambient temperature, in the case of thermosetting binders (for example polyester binders).

Among the explosive compositions according to this preferred first alternative embodiment of the invention, a distinction may be made between those containing no secondary explosive other than 5-oxo-3-nitro-1,2,4-triazole and those which, on the contrary, contain at least one secondary explosive other than 5-oxo-3-nitro-1,2,4-triazole, such as, for example, HMX, RDX, TATB, HNS or PETN. Among these latter explosive compositions, preference is given to those containing at least one secondary explosive chosen from the group consisting of octogen and hexogen.

Among the explosive compositions with a plastic binder which are introduced by compression according to the invention, preference is given to those in which the plastic binder is chosen from the group consisting of fluoro binders, polyurethane binders and polyester binders. Other binders which are usually employed in explosive compositions with a plastic binder and introduced by compression are obviously also suitable. Binders based on butadiene/styrene copolymers may be mentioned as an example.

According to a second preferred alternative embodiment, the explosive compositions are explosive compositions with a plastic binder which are introduced by casting. Such compositions are produced in accordance with to conventional processes which are well known to the specialist for obtaining explosive compositions introduced by casting. Those described in French Patents 2,124,038, 2,225,979 and 2,086,881 may be mentioned, for example.

In general, in order to prepare these explosive compositions with a plastic binder which are introduced by casting, the secondary explosive(s) and a polymerizable liquid resin are first mixed and then the paste obtained is cast in a mould. The paste is then polymerized. Depending on the choice and the adjustment of crosslinking agents, catalysts and wetting agents, moulded explosive compositions of various characteristics are obtained.

Among the explosive compositions according to this second preferred alternative embodiment, a distinction may be made between those which contain no secondary explosive other than 5-oxo-3-nitro-1,2,4-triazole and those which, on the contrary, contain at least one secondary explosive other than 5-oxo-3-nitro-1,2,4-triazole, which is chosen preferably from the group consisting of octogen and hexogen.

Among the explosive compositions with a plastic binder which are introduced by casting according to the invention, preference is given to those in which the plastic binder is a polyurethane binder, the weight content of the binder in the explosive composition being between 12 and 20%. Other binders which are usually employed in explosive compositions with a plastic binder and introduced by casting are obviously also suitable. Silicone binders and polyester binders may be mentioned, for example, especially those obtained by reacting an epoxide with a carboxytelechelic polybutadiene (CTPB).

According to a third preferred alternative embodiment of the invention, the explosive compositions are tolite-based mixtures. These mixtures, introduced by casting, are produced according to the conventional processes for obtaining tolite-based mixtures which are known at present as hexolites, pentolites or octolites, by partly or completely replacing the secondary explosive usually combined with tolite (namely hexogen, pentrite or octogen) with oxynitrotriazole.

Above 80° C. these mixtures consist of suspensions of oxynitrotriazole particles in molten tolite. They may be obtained, for example, by mixing oxynitrotriazole directly with molten tolite.

The weight content of oxynitrotriazole in these mixtures is preferably between 50 and 90%.

The new powders for firearms according to the invention are characterized in that they contain 5-oxo-3-nitro-1,2,4-triazole. They are obtained according to the conventional processes which are well-known to the specialist, by partially or completely replacing the secondary explosives usually employed as an oxidizer charge in the powders with 5-oxo-3-nitro-1,2,4-triazole.

According to a first preferred alternative embodiment, the powders for firearms are triple-base powders in which the 3 bases are nitrocellulose, nitroglycerine and oxynitrotriazole. The contents of nitrocellulose and nitroglycerine are those which are usually present in the triple-base powders comprising them such as, for example, triple-base nitrocellulose/nitroglycerine/nitroguanidine powders, the contents of oxynitrotriazole lying close to those usually present as nitroguanidine.

As an example, the following triple-base powders may be mentioned:

- nitrocellulose (20%) nitroglycerine (20%) oxynitrotriazole (60%)
- nitrocellulose (22%) nitroglycerine (28%) oxynitrotriazole (50%)
- nitrocellulose (30%) nitroglycerine (30%) oxynitrotriazole (40%).

These triple-base powders may contain additives which are conventionally employed, namely, in particular, stabilizers (for example 2-nitrodiphenylamine), plasticizers and flash reducers.

They are obtained, for example, according to a solvent-based, conventional process for triple-base powder formulations.

According to a second preferred alternative embodiment, the powders for firearms are compound powders containing an inert binder. They consist principally of a synthetic resin and of one or more explosive substances acting as an oxidizer charge.

Among the powders for firearms according to this second preferred alternative embodiment, a distinction may be made between those which contain no secondary explosive other than 5-oxo-3-nitro-1,2,4-triazole and those which, on the contrary, contain at least one secondary explosive other than 5-oxo-3-nitro-1,2,4-triazole, chosen preferably from the group consisting of hexogen, octogen and pentrite.

As examples of other oxidizer charges which may be combined with oxynitrotriazole in powders for firearms according to this second preferred alternative embodiment, there may be mentioned, without implying any limitation, triaminoguanidine nitrate, ammonium nitrate, and alkali metal or alkaline-earth metal nitrates.

The inert binder is preferably a polyurethane binder, but it may also, for example, and without implying any limitation, be a polyester binder. Among the polyurethane binders preference is given to those obtained by reacting a hydroxylated polybutadiene with a diisocyanate.

The binder content is preferably of the order of 20% by weight. The compound powders according to the invention generally also contain the usual additives known to the specialist, such as, in particular, plasticizers, antioxidants, flash reducers and erosion reducers.

The powders containing an inert binder for firearms according to the invention may be obtained according to the conventional processes for obtaining this type of powder, and especially using the "aggregate" method which is very widely employed and which has already been described earlier for the manufacture of explosive compositions with a plastic binder which are introduced by casting.

The new compound propellants according to the invention are characterized in that they contain 5-oxo-3-nitro-1,2,4-triazole. They are obtained according to the conventional processes which are well-known to the specialist, by partially or completely replacing the explosive substances usually employed as an oxidizer charge in the propellants with 5-oxo-3-nitro-1,2,4-triazole. They may be obtained according to the conventional processes for obtaining compound propellants and especially using the "aggregate" method known as the "casting" method, which is very widely employed and which has already been described earlier.

They may contain the usual additives known to the specialist, such as, in particular, binder/charge adhesion promoters, antioxidants and catalysts.

According to a first preferred alternative embodiment, the compound propellants according to the invention are gas-generating propellants in which oxynitrotriazole partially or completely replaces the ammonium nitrate usually employed in these compositions.

As an example of such gas-generating compound propellants according to the invention, there may be mentioned those consisting of a polyurethane binder filled with oxynitrotriazole. As an example, the weight content of binder is of the order of 20% and that of oxynitrotriazole of the order of 80%.

According to a second preferred alternative embodiment, the compound propellants according to the invention contain at least one secondary explosive other than oxynitrotriazole, chosen from the group consisting of hexogen and octogen, the binder being preferably a polyurethane binder.

The weight content of binder is, for example, of the order of 20%, and that of all the fillers approximately 80%.

The following examples, which do not imply any limitation, illustrate the invention and demonstrate the many advantages which it offers.

EXAMPLE 1

Synthesis of oxynitrotriazole

Synthesis of oxytriazole (5-oxo-1,2,4-triazole)

115 ml of 85% formic acid are placed in a 500-ml reactor fitted with a stirrer, a condenser, a thermometer and a heating system. The acid is stirred and heated to 70°-75° C. 111.5 g of semicarbazide hydrochloride are added portionwise. It is noted that HCl is given off. When the addition has been completed, the reaction mixture is heated to 85°-90° C. for 6 to 8 hours. After cooling, the mixture is evaporated to dryness. The product is taken up with 200 ml of water and then reevaporated to dryness; this operation is repeated once and then the product is taken up with 140 ml of water at 90° C. After cooling to 10° C. the product is filtered off and washed with iced water. The yield of oxytriazole is 80%. The oxytriazole obtained was identified by IR and carbon-13 NMR. Its melting point is 234° C. and its elemental analysis gives the following result:

| | Theory | Experimental values |
|---|---|---|
| C | 28.24% | 27.96—27.76% |
| H | 3.55% | 3.33—3.18% |
| N | 49.4% | 48.67—49.11% |

Synthesis of oxynitrotriazole (5-oxo-3-nitro-1,2,4-triazole)

170 g of oxytriazole are added to 750 ml of 98% nitric acid while the temperature is maintained at 5°-10° C. The addition takes 2 hours. The materials are then stirred for 3 hours at ambient temperature. This nitric bath is then poured slowly into 600 ml of iced water and left to stand for about 12 hours. After filtration, draining and drying, 208 g of oxynitrotriazole are obtained in the form of a white solid identified by its IR, NMR and mass spectra. The overall yield for the 2 stages together is 64%.

EXAMPLE 2

Triple-base powder

The triple-base powder of the following composition was prepared in accordance with a solvent-based process:

nitrocellulose: 28%
nitroglycerine: 30%
oxynitrotriazole: 40%
2-nitrodiphenylamine (stabilizer): 2%

The solvent pair employed is acetone/ethanol in a weight ratio of 50/50 and the spray rate is 70% based on dry nitrocellulose.

After mixing for 2 h at 20° C. the paste is extruded through a tubular die (external diameter D=3 mm and spindle diameter d=0.6 mm) and then the powder is drained for 24 h at ambient temperature and then dried for 24 h at 50° C.

The monotubular triple-base powder obtained exhibits no special sensitivity. It has a friction sensitivity of 309 N, an ignition by an electric spark greater than 726 mJ and an ignition by capacitive discharges in a confined environment of more than 15.6 J.

Its physicochemical properties are as follows:

water: 0.047% ethanol: <0.05% acetone: <0.05% actual density (gas pycnometer): 1.640 g/cm$^3$ (theoretical value 1.718 g/cm$^3$)

The dimensions of the finished powder are as follows: length (L): 3.87 mm; external diameter (D): 3.31 mm; hole diameter (d): 0.56 mm; powder thickness (web): 1.38 mm. Firing in a 200-cm$^3$ manometer bomb at several charge densities (0.12; 0.15; 0.18; 0.20 and 0.23 g/cm$^3$) enabled the combustion velocity curve to be determined. The latter is quite uniform. A velocity of 110 mm/s at 100 MPa is found.

The flame temperature is low (3,600 K) compared to that of a double-base 60/40 nitrocellulose/nitroglycerine powder (approximately 3,900 K), while the energy per unit volume is similar. It is higher, however, than that of a triple-base powder containing nitroguanidine (approximately 3,000 K). The theoretical specific energy (1.15 MJ/kg), on the other hand, is higher than that of a triple-base powder containing nitroguanidine (1.08 MJ/kg) but slightly lower than that of a double-base powder (1.19 MJ/kg).

EXAMPLE 3

Powder with an inert binder for firearms

The powder produced is in the form of cylindrical particles comprising 7 channels parallel to the axis of the particles. It is used for high-calibre ammunition.

Its weight percentage composition is as follows:

| | | |
|---|---|---|
| 20% binder | hydroxylated polybutadiene R45M | 11.31% |
| | polyether | 0.34% |
| | toluene diisocyanate | 0.94% |
| | dioctyl azelate | 7.10% |
| | methylenedi(ortho-tert-butyl-para-methylphenol) | 0.12% |
| | lecithin | 0.19% |
| 80% charges | hexogen | 60% |
| | oxynitrotriazole | 20% |

To produce it, the mixture of the various ingredients of the composition, with the exception of isocyanate, is first homogenized in a mixer at 60° C. under reduced pressure. A part of the isocyanate is then added so that the NCO/OH ratio is 0.72. After homogenization, the paste is precrosslinked at 60° C. for 5 days and it is then introduced into a compounding extruder. The remainder of the isocyanate is then added and then the paste is extruded through a die having the required final geometry of the powder.

The rods obtained are then heated at 60° C. for 2 days and are then cut into granules.

The dimensions of the granules obtained are as follows:

L: 8.1 mm; D: 5.4 mm; d: 0.6 mm; Web: 0.6 mm

Its measured density is 1.52 g/cm$^3$.

Firings in a manometer bomb have made it possible to measure a combustion velocity of 40 mm/s at 100 MPa and a specific energy of 0.97 MJ/kg.

The flame temperature is 2,211 K.

When compared to the same powder consisting of the same binder, at the same concentration, but charged solely with hexogen (instead of a mixture of hexogen and oxynitrotriazole), the powder containing oxynitrotriazole according to the invention has a lower flame temperature (2,211 K instead of 2,430 K) and a lower concentration of reducing gases such as $H_2$ and CO.

EXAMPLE 4

Compound propellant

A gas-generating compound propellant consisting of 81% by weight of oxynitrotriazole and 19% by weight of a polyurethane binder was produced. The basic constituents of this binder are hydroxylated polybutadiene R45M and methylenedicyclohexyl diisocyanate. This binder also contains a plasticizer (dioctyl azelate), an antioxidant (ionol) and lecithin. This compound propellant was produced according to the conventional method known as the "aggregate" or "casting" method, using a NCO/OH ratio of 1.

Its measured density is 1.59 g/cm$^3$ and its mechanical properties are satisfactory. The flame temperature is 1,365 K. Strand burner combustion of this propellant was carried out. The combustion velocity (Vc) is 1.9 mm/s at 7 MPa and the coefficients a and n in the law $Vc=aP^n$ are a=0.67 and n=0.53.

I claim:

1. A gunpowder having an oxidizer charge composition comprising 5-oxo-3-nitro-1,2,4-triazole, and at least one gunpowder forming ingredient.

2. A triple base gunpowder composition as claimed in claim 1, further comprising nitrocellulose and a liquid nitric ester.

3. A gunpowder according to claim 1 for firearms wherein the 5-oxo-3-nitro-1,2,4-triazole is used in an amount sufficient to lower flame temperature of the gunpowder and to reduce firearm barrel erosion thereby.

4. A gunpowder composition as claimed in claim 2, wherein said liquid nitric ester comprises nitroglycerine.

5. A gunpowder composition as claimed in claim 1, further including an inert binder.

6. A gunpowder composition as claimed in claim 5, wherein said inert binder is polyurethane.

7. A gunpowder composition as claimed in claim 6, wherein said polyurethane binder is obtained by reacting a hydroxylated polybutadiene with a diisocyanate.

8. A gunpowder composition as claimed in claim 5, wherein said inert binder is present in an amount of about 20% by weight of said composition.

9. A gunpowder composition as claimed in claim 5, wherein said composition further includes at least one compound selected from octogen, hexogen and pentrite.

10. A composition as claimed in claim 5, wherein said composition further includes at least one compound selected from triaminoguanidine nitrate, ammonium nitrate, and an alkali metal or alkaline-earth metal nitrate.

11. A composition according to claim 2, comprising from 40% to 60% oxynitrotriazole in the triple base powder.

12. A solid propellant composition comprising 5-oxo-3-nitro-1,2,4-triazole and a binder.

13. A solid propellant composition as claimed in claim 12, wherein said binder is polyurethane.

14. A solid propellant composition as claimed in claim 13, wherein said polyurethane binder is present in said composition in an amount of about 20 percent by weight and said triazole is present in an amount of about 80 percent by weight.

15. A solid propellant composition as claimed in claim 12, wherein said composition further includes at least one compound selected from hexogen and octogen.

16. A solid propellant composition as claimed in claim 12, wherein said binder comprises hydroxylated polybutadiene, polyether, toluene diisocyanate, dioctyl azelate, methylene di(ortho-tert-butyl-para-methylphenol) and lecithin and wherein said composition further includes hexogen.

17. A solid propellant composition as claimed in claim 16, wherein said hexogen is present in said composition in an amount of about 60 percent by weight and said triazole is present in an amount of about 20 percent by weight.

18. A solid propellant composition as claimed in claim 12, and being a gas-generating compound propellant less hygroscopic than a propellant containing ammonium nitrate.

19. A method of using the composition of claim 1 as a gunpowder comprising subjecting the same to gunpowder-firing conditions.

20. A method according to claim 19, wherein the gunpowder is fired in a firearm, and wherein the oxnitrotriazole is used in an amount sufficient to lower flame temperature of the gunpowder and to reduce firearm barrel erosion thereby.

21. A method of using the composition of claim 12 as a propellant comprising subjecting the same to propellant-combusting conditions.

22. A method according to claim 21, wherein a gas-generating compound propellant is used, and the propellant is less hygroscopic than a propellant containing ammonium nitrate.

* * * * *